US009365309B2

(12) United States Patent
Salas

(10) Patent No.: US 9,365,309 B2
(45) Date of Patent: Jun. 14, 2016

(54) PREFORMED BAG FEEDER FOR PACKAGING MACHINES

(71) Applicant: BOSSAR PACKAGING, S.A., Barcelona (ES)

(72) Inventor: Rodrigo Israel Salas, Barcelona (ES)

(73) Assignee: Bossar Packaging, S.A., Barcelona (ES)

( * ) Notice: Subject to any disclaimer, the term of this patent is extended or adjusted under 35 U.S.C. 154(b) by 563 days.

(21) Appl. No.: 13/791,374

(22) Filed: Mar. 8, 2013

(65) Prior Publication Data

US 2013/0232915 A1 Sep. 12, 2013

(30) Foreign Application Priority Data

Mar. 9, 2012 (ES) ..... 201230354

(51) Int. Cl.
*B65B 43/12* (2006.01)
*B65B 43/16* (2006.01)
(Continued)

(52) U.S. Cl.
CPC ..... *B65B 43/12* (2013.01); *B65B 43/16* (2013.01); *B65B 43/18* (2013.01); *B65H 3/0816* (2013.01); *B65H 9/00* (2013.01); *B65H 2301/33214* (2013.01); *B65H 2301/33222* (2013.01); *B65H 2301/36* (2013.01);
(Continued)

(58) Field of Classification Search
CPC ..... B65B 43/14–43/36; B65B 43/42; B65B 43/44; B65B 43/465; B65B 43/52; B65B 53/54
USPC ..... 53/284.7, 384.1, 570, 571, 573; 493/179, 180
See application file for complete search history.

(56) References Cited

U.S. PATENT DOCUMENTS 3,717,336 A * 2/1973 Short ..... B65H 3/443 271/236
3,727,372 A * 4/1973 Roberts ..... B65B 57/00 53/502

(Continued)

FOREIGN PATENT DOCUMENTS

DE 2549264 A1 * 5/1977 ..... B65B 43/18
ES 22229836 4/2005

(Continued)

OTHER PUBLICATIONS

Examination Report of Spanish Patent Office completed May 27, 2013 in priority Spanish application No. 201230354, filed Mar. 9, 2012, with English translation of paragraph 2, p. 4/4 of said Examination Report.

*Primary Examiner* — Hemant M Desai
*Assistant Examiner* — Valentin Neacsu
(74) *Attorney, Agent, or Firm* — Brown & Michaels, PC

(57) ABSTRACT

Preformed bag feeder for packaging machines which comprises buckets containing the preformed bags and first means for picking up successive bags from the buckets and for supplying the bags, one by one, to fastening clamps located at a point of the trajectory of the transporter, the clamps allowing pick-up of the successive bags, in a vertical orientation, by the transporter. The transporter comprises, following the fastening clamps, a positioner that carries out the horizontal and vertical alignment of the successive bags with respect to horizontal and vertical reference lines; arranging the bags in a fixed position wherein the lower extremity of the successive bags matches the horizontal reference line and the aforementioned bags are centered with respect to the vertical reference line.

5 Claims, 5 Drawing Sheets

(51) Int. Cl.

| | |
|---|---|
| ***B65B 43/18*** | (2006.01) |
| ***B65H 3/08*** | (2006.01) |
| ***B65H 9/00*** | (2006.01) |
| *B65B 43/26* | (2006.01) |
| *B65B 43/42* | (2006.01) |
| *B65B 43/44* | (2006.01) |
| *B65B 43/52* | (2006.01) |
| *B65B 43/54* | (2006.01) |

(52) U.S. Cl.
CPC ..... *B65H 2301/42264* (2013.01); *B65H 2301/44722* (2013.01); *B65H 2701/191* (2013.01)

(56) References Cited

U.S. PATENT DOCUMENTS 3,855,907 A * 12/1974 Johnson ..... B32B 19/36 493/235
3,882,657 A 5/1975 Fishbein et al.
4,353,198 A 10/1982 Koppe
5,452,567 A * 9/1995 Lieder ..... B65B 43/30 141/166
5,558,482 A * 9/1996 Hiroki ..... B65H 9/00 414/217
5,704,197 A * 1/1998 Gifford ..... B65B 43/465 141/114
5,862,653 A * 1/1999 Solano ..... B65B 1/02 53/284.7
6,050,061 A * 4/2000 Todd ..... B65B 59/02 53/201
6,142,288 A * 11/2000 Hotkowski ..... B65H 20/02 198/403
6,550,601 B2 * 4/2003 Jurisch ..... B23Q 3/186 198/345.3
6,637,178 B1 * 10/2003 Cook ..... B65B 5/067 53/254
2002/0170276 A1 * 11/2002 Hiramoto ..... B65B 43/30 53/459
2005/0067771 A1 * 3/2005 Carolan ..... B65H 9/002 271/228

FOREIGN PATENT DOCUMENTS

GB 934268 A * 8/1963 ..... B65B 43/12
GB 1 275 930 6/1972

* cited by examiner

PREFORMED BAG FEEDER FOR PACKAGING MACHINES

CROSS-REFERENCE TO RELATED APPLICATIONS

This application claims priority to Spain application no. P201230354, filed Mar. 9, 2012, the disclosure of which is incorporated herein by reference and made a part of this application.

BACKGROUND OF THE INVENTION

1. Field of the Invention

A preformed bag feeder applicable to packaging machines, and mainly, although not in a limitative manner, to horizontal packaging machines.

2. Description of the Related Art

Horizontal packaging machines working with preformed bags, sealed by their lateral and lower extremities and provided with an open upper mouth, are currently known in the market. These packaging machines are provided with a transporter that moves the preformed bags horizontally, in the vertical position and intermittently through successive opening, filling, closing and filling stations of the upper extremity of the aforementioned bags.

It is also known that such packaging machines have a feeder for the supply of the preformed bags to the transporter in charge of moving them through the successive stations of the packaging machines.

A feeder known for this type of packaging machines is provided with buckets containing the preformed bags in the horizontal position and piled or superimposed vertically, with first means that pick up the successive bags from the buckets and supply them one by one to fastening clamps located at a point of the trajectory of the transporter, the clamps allowing the pick up of the successive bags, in the vertical position, by said transporter.

The first means may be of different configurations, being constituted in one known case by a retractable arm bearing a rotary shaft provided with suction cups that pick up the bags, one by one and in the horizontal position, from a bucket, and the combined retractable and rotary movement of the arm and the shaft supplies the bags in the vertical position to the aforementioned fastening clamps.

A usual problem in this type of feeders is that the preformed bags piled inside the buckets are not perfectly parallel or in matching positions since slackness between the contour of the preformed bags and the internal walls of the buckets is necessary for the bags not to be stuck in their interior and be extracted in an individualized manner by the first means in charge of transferring them to the fastening clamps.

This slackness allows the preformed bags contained in their interior to move and turn slightly in the lateral direction, and therefore the bags are not found exactly in the same position.

The foregoing determines that the successive preformed bags are supplied to the fastening clamps in positions with different degrees of lateral inclination, height or lateral movement.

Given that these fastening clamps are in charge of supplying the successive bags to the transporter by moving them in that same position through the successive work stations, an important problem arises when the bags supplied by the clamps are initially in a position that is excessively turned towards the lateral direction or moved both horizontally and vertically.

This problem can be of such a magnitude that it can lead to the ruling out of the use of packaging machines with preformed bags. I have invented a bag feeder for such packaging machines which effectively avoids this problem.

SUMMARY OF THE INVENTION

The present invention relates to a preformed bag feeder for packaging machines; mainly applicable to horizontal packaging machines and in charge of the supply of successive preformed bags, sealed by their lateral and lower extremities, to a transporter that moves them horizontally in the vertical position and intermittently through successive opening, filling, closing and filling stations of the upper extremity of the aforementioned bags, the feeder having buckets containing the preformed bags, and first means that pick up the successive bags from the buckets and supply them one by one to fastening clamps located at a point of the trajectory of the transporter, the fastening clamps allowing the pick up of the successive bags in the vertical position by the transporter.

The feeder of the invention presents the particularity of incorporating a positioner that guarantees the horizontal and vertical alignment of the successive preformed bags with respect to horizontal and vertical reference lines, so the movement of the successive preformed bags towards the successive stations of the packaging machine is carried out from a certain point and position of the bags.

The preformed feeder for packaging machines according to the invention, being of the type mentioned above and according to the description of the preamble of the first claim presented hereinbelow, presents the particularity of comprising a positioner that carries out the horizontal and vertical alignment of the successive preformed bags with respect to horizontal and vertical reference lines with the purpose of arranging them in a fixed position prior to being moved by the transporter of the machine towards the successive stations (i.e., opening, filling, closing and sealing) of the packaging machine.

To achieve the foregoing and according to the invention, this feeder comprises, following the fastening clamps, a positioner that carries out the horizontal and vertical alignment of the successive preformed bags with respect to horizontal and vertical reference lines; arranging the successive bags in a fixed position, wherein the lower extremity of the successive bags matches the horizontal reference line and the aforementioned bags are centered with respect to the vertical reference line.

The positioner of the invention therefore guarantees that the bags are correctly aligned, both horizontally and vertically, and are in a fixed position prior to being moved by the transporter of the machine towards the operating stations thereof.

According to the invention, the positioner comprises: a longitudinal passage open at the top, arranged in the movement trajectory of the preformed bags by the transporter and closed at the bottom by a surface for the support of the lower extremity of the preformed bags when the bags are released inside the passage; the lower surface defining the horizontal reference line.

The positioner also comprises at least two movable lateral centering elements between an opening position, wherein they are arranged outside the trajectory of the bags, and a closing position, wherein the centering elements act on the lateral extremities, front and rear, of the bag located inside the positioner, establishing its centering with respect to a vertical reference line equidistant with respect to the lateral centering elements.

In a preferred embodiment, a preformed bag feeder for horizontal packaging machines supplied with a plurality of preformed bags sealed along their lateral and lower extremities is disclosed, which comprises a plurality of buckets for containing the preformed bags in a horizontal orientation, first means to pick up successive bags from the buckets and supply them, one by one, to fastening clamps located at a point of a trajectory of a transporter, the clamps being structured and arranged to facilitate the successive pick up of the bags in a vertical orientation, a transporter adapted to receive the bags from the fastening clamps, and a positioner adjacent the transporter for providing horizontal and vertical alignment of the bags, the positioner having at least one horizontal lower reference surface with respect to the bags, wherein the lower edge of each successive bag engages and matches the lower reference surface in a manner to maintain them in a centered relationship with the lower reference surface through successive opening, filling, closing and sealing stations.

A swing arm is positioned adjacent the buckets and arranged to pick up each bag, one by one, when in the horizontal orientation, the swing arm being arranged to successively rotate each bag to a vertical orientation.

The swing arm preferably includes suction cups to successively lift each preformed bag from the buckets.

The swing arm is arranged to collect each preformed bag from each said bucket and deliver it in a vertical position to fastening clamps.

The transporter is preferably arranged to move the preformed bags through successive opening, filling, closing and sealing stations of the packaging machine.

The positioner comprises a longitudinal passage open on top, and arranged in the movement trajectory of the bags by the transporter, the longitudinal passage being closed on the bottom by the horizontal lower reference surface which supports the lower extremity of each bag when they are released inside the longitudinal passage.

The alignment of the lower extremity of each bag with the horizontal guide and support surface confirms that each bag is arranged in a vertical orientation when transported through the successive opening, filling, closing and sealing stations.

The positioner preferably further comprises two lateral centering elements movable between an open position wherein the lateral centering elements are arranged outside the trajectory of the bags, and a closed position wherein the centering elements act on the lateral extremities, front and rear, of each bag with respect to a vertical reference line, equidistant with respect to the lateral centering elements.

The positioner is preferably capable of positioning each bag in a predetermined fixed position, thereby eliminating possible forward or backward movement in the horizontal direction, while determining an exact initial position for pick up and transportation of the bags by the transporter towards the successive opening, filling, closing and sealing stations.

BRIEF DESCRIPTION OF THE DRAWINGS

In order to supplement the description being presented herein, and with the purpose of facilitating the comprehension of the characteristics of the invention, the present specification is accompanied by a set of drawings representing the following in an illustrative rather than a limitative manner.

DETAILED DESCRIPTION OF THE PREFERRED EMBODIMENTS

Figure 1:
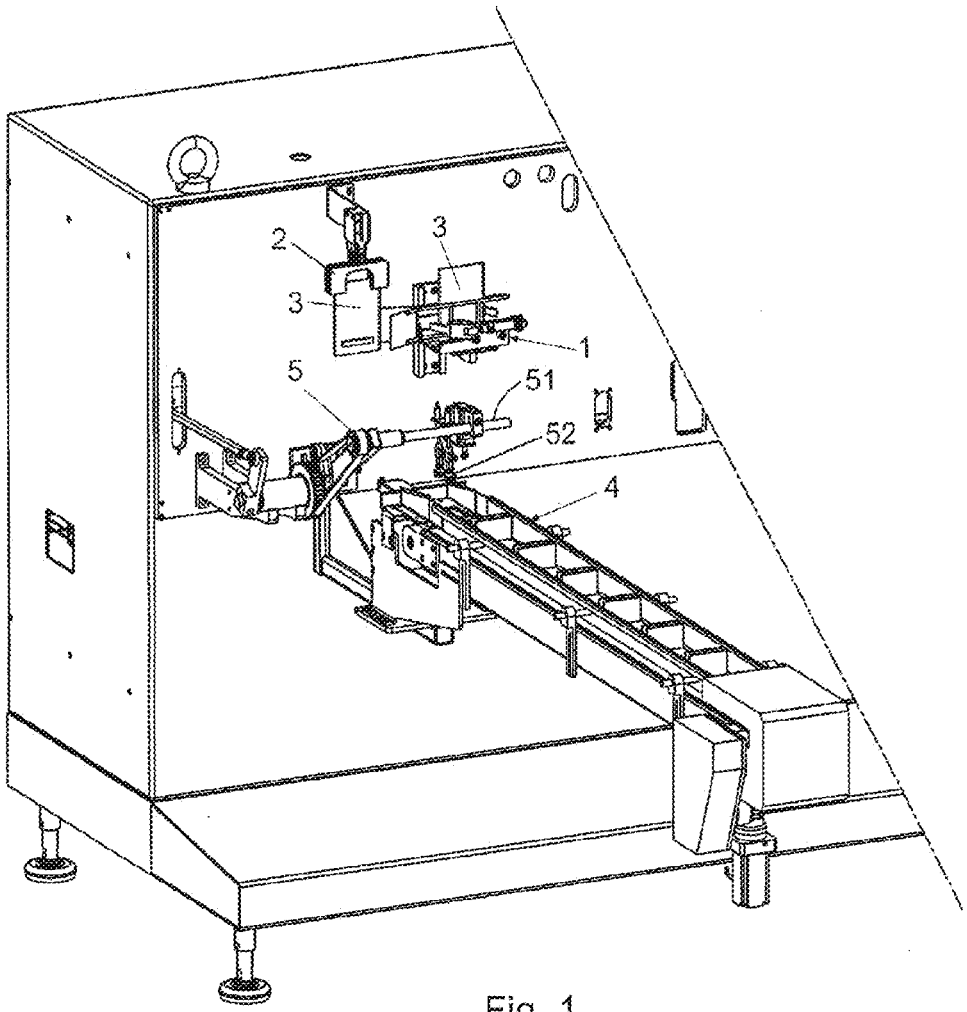
FIG. 1 shows a partial perspective view of the preformed bag feeder for packaging machines, according to the invention, applied to a horizontal packaging machine whose external casing has been represented, and a part of the transporter in charge of moving the preformed bags towards the successive opening, filling, closing and sealing stations of the packaging machine.
Figure 2:
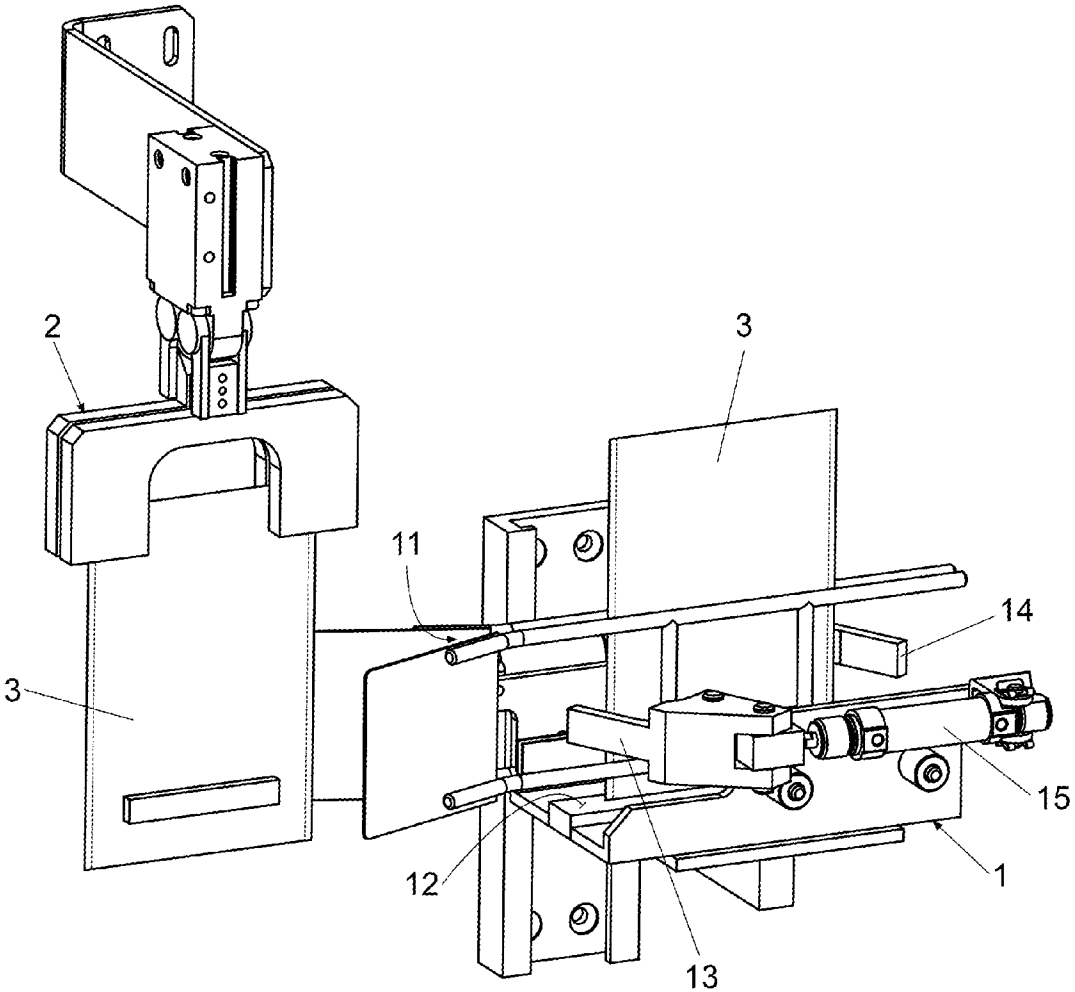
FIG. 2 shows a perspective view of an example of a preferred embodiment of the clamps and the positioner in charge of carrying out the horizontal and vertical alignment of the bags prior to being moved by the transporter of the packaging machine towards the opening, filling, closing and sealing stations of the packaging machine.

Referring initially to FIG. 1, the preformed bag feeder comprises a positioner 1 arranged follow fastening clamps 2 that receive successive preformed bags 3 in the vertical position, originating from buckets 4, wherein they are piled and are in the horizontal position.

The preformed bags 3 are supplied to the clamps 2 by first means, which in this embodiment, comprises a swing arm 5 bearing a rotary shaft 51, provided with suction cups 52.

In each swing of the swing arm 5, the suction cups 52 collect a preformed bag 3 from the bucket 4 being used, and deliver it, in the vertical position, to the fastening clamps 2, where they are picked up by a transporter 6, in charge of taking them towards the positioner 1 and subsequently towards the successive opening, filling, closing and sealing stations of the packaging machine.

The positioner 1 comprises: a longitudinal passage 11 open on top and arranged in the movement trajectory of the bags 3 by the transporter 6, the longitudinal passage being closed on the bottom by a horizontal guide surface 12 supporting the lower extremity of the preformed bags 3 when they are released inside the passage 11. This way, the alignment of the lower extremity of the bags 3 with a horizontal reference line precisely defined by the lower surface 12 of the positioner 1 is obtained.

This horizontal alignment of the bags 3 also guarantees that the bags 3 are arranged vertically, supported on their lower extremity, thus eliminating possible lateral inclinations of the bags 3.

Figure 3:
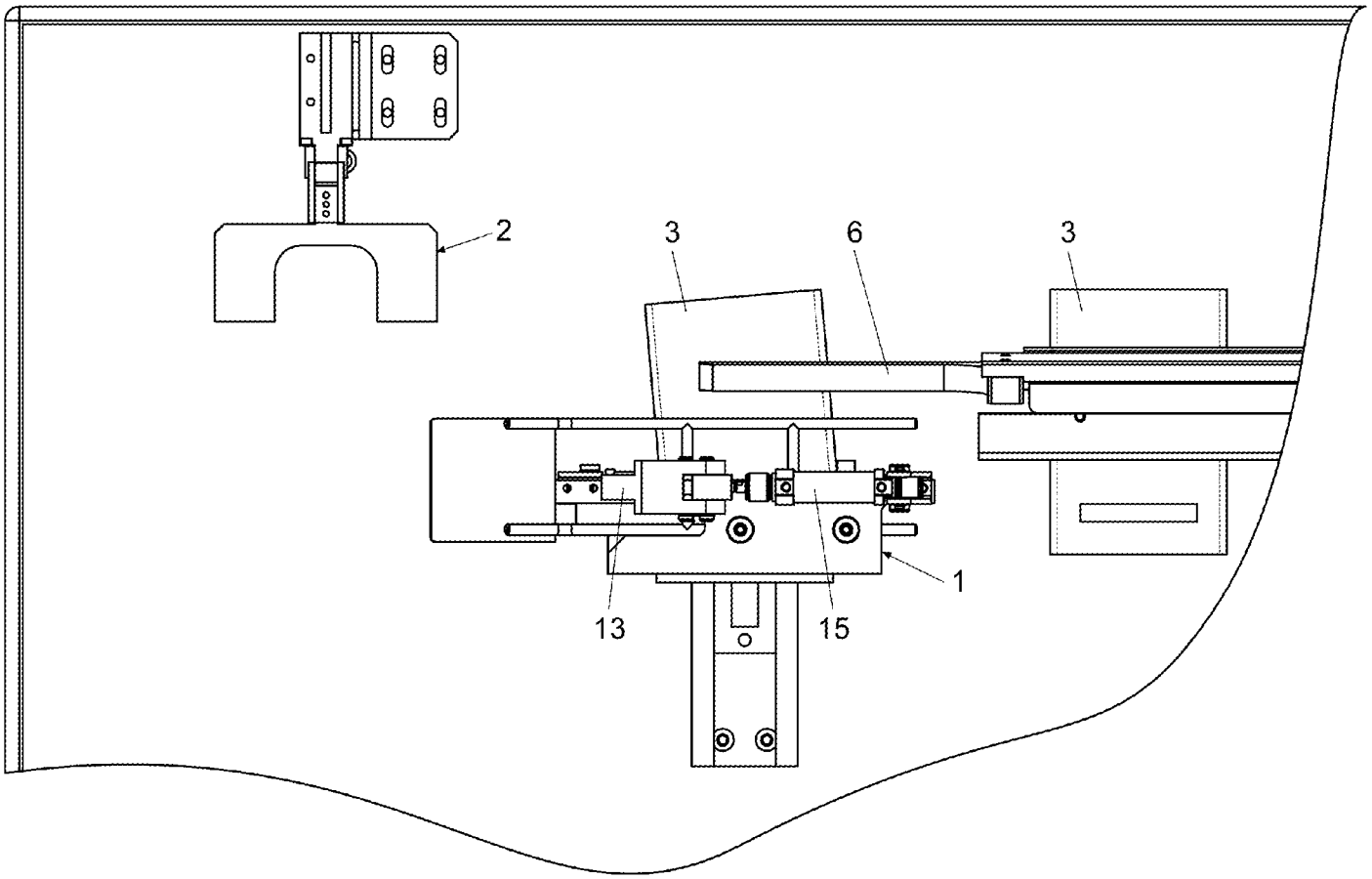
FIG. 3 shows a frontal elevated view of the positioner during the reception of a bag moved by the transporter and laterally inclined.
Figure 4:
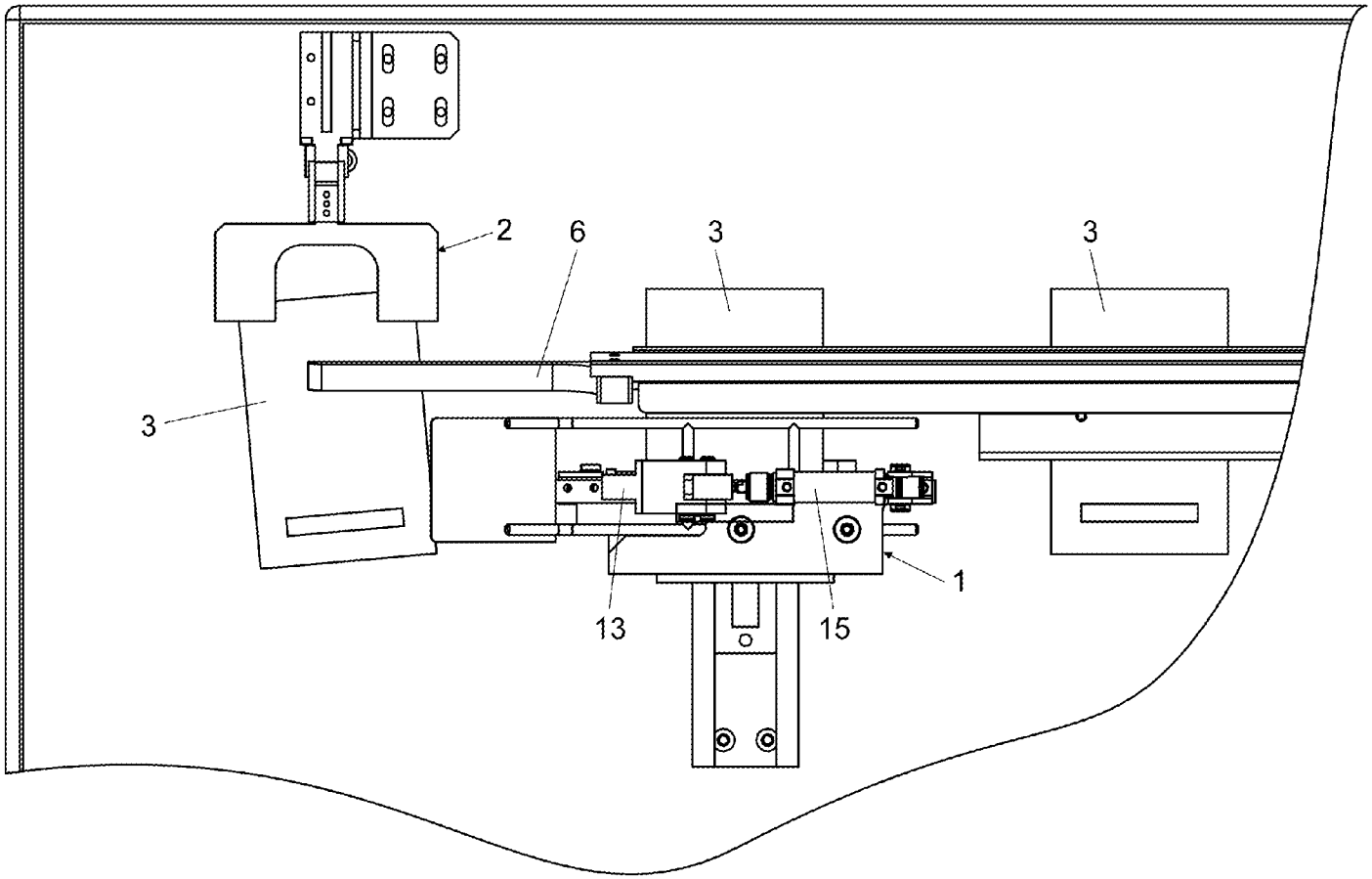
FIG. 4 shows a view analogous to FIG. 3, after the bag is released by the transporter and supported by its lower extremity on a lower surface of the positioner, which defines a horizontal reference line.
Figure 5:
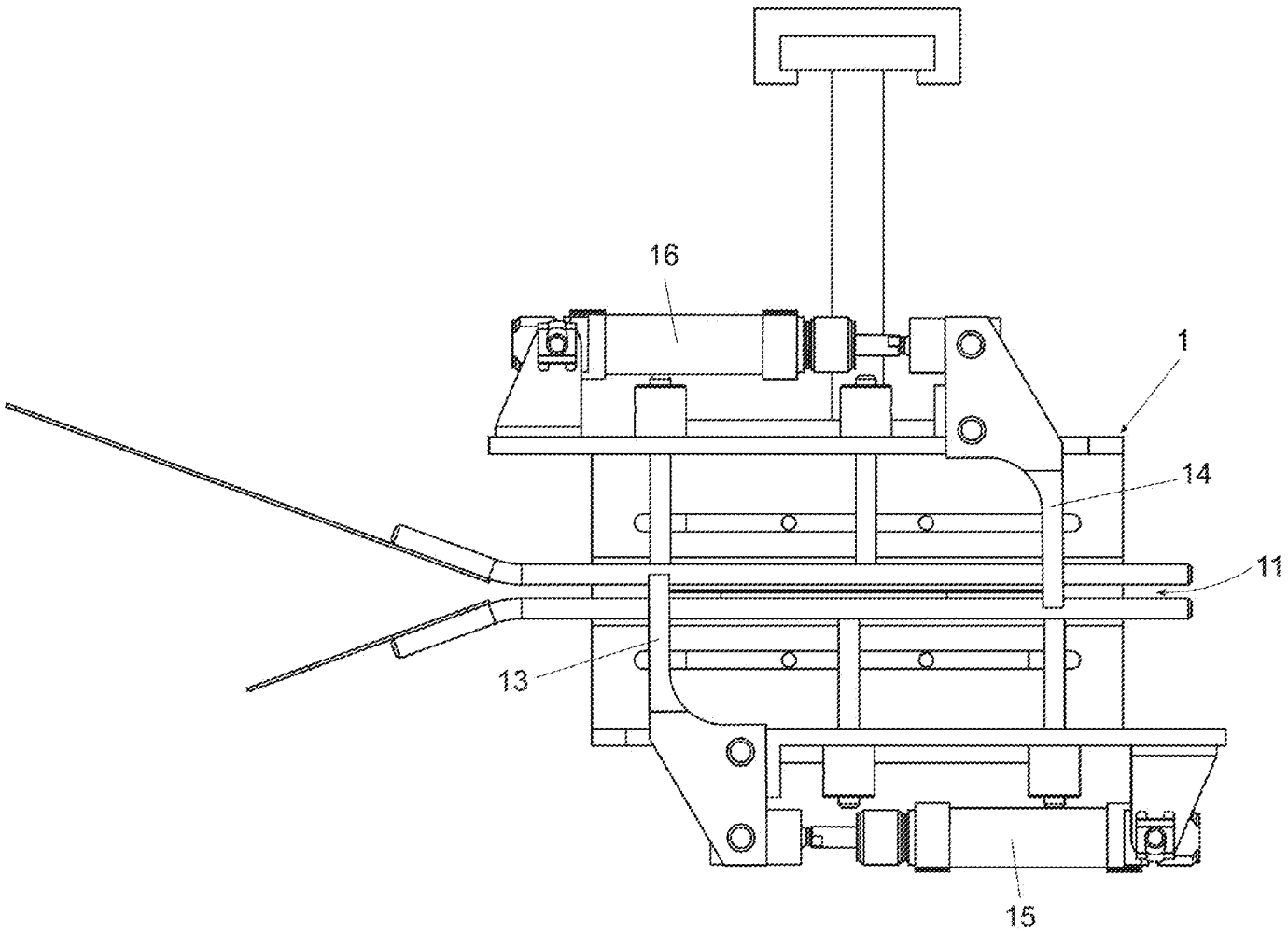
FIG. 5 shows an upper plant view of the positioner with the lateral centering elements in their closing position, establishing the centering of the preformed bag with respect to a vertical reference line.

The positioner 1 also has two lateral centering elements 13, 14, movable between an opening position represented, for example in FIG. 3, wherein the lateral centering elements 13, 14 are arranged outside the trajectory of the bags 3 and in a closing position, where the centering elements 13, 14 act on the lateral extremities, front and rear, of the bag 3, as shown in FIG. 5, establishing the centering of the bag 3 with respect to a vertical reference line, equidistant with respect to the lateral centering elements 13, 14. In the example shown, the lateral centering elements 13, 14 are retractable and operable by means of respective pneumatic cylinders 15, 16.

In addition to positioning the bag 3 correctly with respect to the horizontal and the vertical, the positioner 1 also positions the bag 3 in a fixed position, thus eliminating possible forward or backward moves in the horizontal direction, determining an exact initial position for their pick up and transportation by the transporter 6 towards the successive opening, filling, closing and sealing stations of the packaging machine.

After describing the nature of the invention, as well as an embodiment example, in a sufficient manner, it should be noted for all opportune effects that the materials, shape, size and arrangement of the described elements may be modified as long as the modification does not entail an alteration of the essential characteristics of the invention claimed as follows.

LIST OF REFERENCES IN ORDER OF APPEARANCE

1 Positioner
2 Fastening Clamps
3 Preformed Bags
4 Buckets
5 Swing Arm
51 Rotary Shaft
52 Suction Cups
6 Transporter
11 Longitudinal Passage
12 Horizontal Surface/Lower Surface
13, 14 Lateral Centering Elements
15, 16 Pneumatic Cylinders

The invention claimed is:

1. A preformed bag feeder for supplying successive preformed bags having a lower extremity and an upper extremity to a packaging machine having a transporter that moves the preformed bags horizontally along a trajectory in a vertical orientation through successive opening, filling, closing and sealing stations; said feeder comprising:

a plurality of buckets containing the preformed bags;

at least one fastening clamp for holding a preformed bag in a vertical orientation, located at a point aligned with the trajectory of the bags through the transporter;

first means for picking up a preformed bag from one of the plurality of buckets and supplying the preformed bag to the at least one fastening clamp;

a positioner movable between the at least one fastening clamp and the transporter for aligning the preformed bags with respect to horizontal and vertical reference lines, arranging them in a fixed position, the positioner comprising:

a longitudinal passage arranged in the trajectory of the bags through the transporter, the passage being open on top;

a horizontal surface closing a bottom of the longitudinal passage for supporting the preformed bags when the bags are inside the longitudinal passage; said horizontal surface defining the horizontal reference line; and at least two lateral centering elements movable between an opening position outside the trajectory of the bags through the transporter, and a closing position wherein said centering elements center preformed bags located inside the positioner with respect to a vertical reference line; such that the lower extremity of the preformed bags matches said horizontal reference line and the preformed bags are centered with respect to said vertical reference line.

2. A preformed bag feeder for horizontal packaging machines supplied with a plurality of preformed bags, each performed bag having an upper extremity and sealed lower extremity, comprising:

a) a plurality of buckets for containing the plurality of preformed bags in a horizontal orientation;

b) at least one fastening clamp for holding a preformed bag in a vertical orientation, located at a point aligned with a trajectory of the bags through the transporter;

c) a first means for picking up a preformed bag from one of the plurality of buckets and supplying the preformed bag in a vertical orientation to a fastening clamp; comprising:

a swing arm having suction cups for lifting preformed bags, the swing arm being positioned adjacent to the plurality of buckets and arranged to pick up a bag in the horizontal orientation from one of the plurality of buckets using the suction cups, and to rotate the bag to a vertical orientation and to deliver the preformed bag in the vertical orientation to a fastening clamp;

c) a transporter adapted to receive the preformed bag from the fastening clamp and to move the preformed bag along a trajectory through successive opening, filling, closing and sealing stations of the packaging machine; and d) a positioner adjacent said transporter for providing horizontal and vertical alignment of the bags, comprising a longitudinal passage open on top, and aligned with the trajectory of the bags moving through the transporter, the longitudinal passage being closed on a bottom by a horizontal lower reference surface which supports the lower extremity of each preformed bag inside the longitudinal passage; wherein the lower extremity of each preformed bag engages and matches the horizontal lower reference surface in a manner to maintain the preformed bag in alignment with the horizontal lower reference surface through successive opening, filling, closing and sealing stations.

3. The preformed bag feeder of claim 2 wherein the alignment of the lower extremity of each said bag with said horizontal lower reference surface maintains the preformed bag in the vertical orientation when the bag is transported by the transporter through the opening, filling, closing and sealing stations.

4. The preformed bag feed of claim 2, wherein said positioner further comprises two lateral centering elements movable between an open position wherein said lateral centering elements are arranged outside the trajectory of the bags through the transporter, and a closed position wherein said centering elements center preformed bags located inside the positioner with respect to a vertical reference line, equidistant with respect to said lateral centering elements.

5. The preformed bag feeder of claim 2, wherein the positioner positions the preformed bag in a predetermined position relative to the transporter, thereby eliminating possible forward or backward movement of the preformed bag in a horizontal direction, while determining an exact initial position for pick up and transportation of the preformed bag by the transporter towards the successive opening, filling, closing and sealing stations.

* * * * *